US010888478B2

(12) United States Patent
Stephens

(10) Patent No.: US 10,888,478 B2
(45) Date of Patent: Jan. 12, 2021

(54) LIMB IRRIGATION PAN DEVICE

(71) Applicant: Shannon Stephens, La Quinta, CA (US)

(72) Inventor: Shannon Stephens, La Quinta, CA (US)

( * ) Notice: Subject to any disclaimer, the term of this patent is extended or adjusted under 35 U.S.C. 154(b) by 351 days.

(21) Appl. No.: 15/839,435

(22) Filed: Dec. 12, 2017

(65) Prior Publication Data

US 2019/0175432 A1 Jun. 13, 2019

(51) Int. Cl.

| | |
|---|---|
| ***A61G 7/075*** | (2006.01) |
| ***A61G 13/12*** | (2006.01) |
| ***A61G 7/05*** | (2006.01) |
| *A61G 13/10* | (2006.01) |
| *A61H 33/00* | (2006.01) |

(52) U.S. Cl.

CPC ..... *A61G 7/075* (2013.01); *A61G 7/0503* (2013.01); *A61G 13/1235* (2013.01); *A61G 13/102* (2013.01); *A61G 13/126* (2013.01); *A61G 13/127* (2013.01); *A61G 13/1245* (2013.01); *A61H 33/00* (2013.01)

(58) Field of Classification Search

CPC ..... A61M 3/0287; A61M 3/02; A61G 7/0755; A61G 13/102; A61G 13/126

See application file for complete search history.

(56) References Cited

U.S. PATENT DOCUMENTS 635,891 A 10/1899 Holberg
665,673 A 1/1901 Fraley
2,086,244 A 7/1937 Smith
2,709,435 A * 5/1955 Kress ..... A61G 7/0755 604/293
3,083,376 A * 4/1963 Johns ..... A61G 7/02 4/621

(Continued)

*Primary Examiner* — Susan S Su

(74) *Attorney, Agent, or Firm* — Daniel M. Cohn; Howard M. Cohn

(57) ABSTRACT

A kit of parts for assembling a limb irrigation pan device includes a base having first and second opposing sides formed with alternating indentations and protrusions extending along the first and second opposing sides. A first side wall has alternating spaced indentations and protrusions formed along a bottom section of the first side wall to enable the first side wall to be mounted to the base by inserting the alternating spaced indentations and protrusions formed along the bottom section of first side wall into corresponding alternating indentations and protrusions along the first side of the base. A second side wall has alternating spaced indentations and protrusions formed along a bottom section of the second side wall to enable the second side wall to be mounted to the base by inserting the alternating spaced indentations and protrusions formed along the bottom section of the second side wall into corresponding alternating indentations and protrusions along the second side of the base. First and second end panels mount onto opposite ends of the base so as to extend upward and substantially perpendicular to the base in parallel relation to each other to form a frame with the first and second side walls. A sling has coupling components along two opposite sides. The coupling components are adapted to attach the sling to the first and second side walls whereby the sling is coupled to the frame.

20 Claims, 4 Drawing Sheets

(56) References Cited

U.S. PATENT DOCUMENTS 3,112,498 A * 12/1963 Hoffman ..... A61G 7/0005 4/585
3,281,172 A * 10/1966 Kuehl ..... A47K 3/284 52/592.1
3,532,336 A * 10/1970 Baker ..... A61G 13/12 5/650
3,611,450 A * 10/1971 Bost ..... A47K 1/04 4/628
3,734,057 A * 5/1973 Lee ..... A01K 1/011 119/163
3,920,144 A 11/1975 Callen
4,034,424 A * 7/1977 Budlong ..... A47K 3/03 4/540
4,055,863 A 11/1977 Duval
4,785,486 A * 11/1988 Viesturs ..... A47K 3/06 4/585
5,148,771 A * 9/1992 Schuett ..... A01K 1/01 119/479
5,228,150 A 7/1993 Parker
5,381,562 A * 1/1995 Holloway ..... A45D 19/06 4/516
5,393,299 A * 2/1995 Brettin ..... A61H 9/00 4/621
5,662,069 A * 9/1997 Smith ..... A01K 13/001 119/665
6,988,467 B1 * 1/2006 Smith ..... A01K 13/001 119/673
7,357,098 B2 * 4/2008 Foster ..... A01K 13/001 119/673
8,061,304 B1 * 11/2011 Ramsay ..... A01K 13/001 119/671
8,434,491 B2 * 5/2013 Born ..... A61B 50/33 128/845
8,968,262 B2 * 3/2015 Tapadiya ..... A61B 50/30 604/356
9,833,111 B2 * 12/2017 Torres ..... A47K 3/30
9,943,462 B2 * 4/2018 Gathers ..... A61H 33/6005
10,278,878 B2 * 5/2019 Parsell ..... A61M 3/0287
2001/0025389 A1 10/2001 Kitamura
2012/0255115 A1 * 10/2012 Akesson ..... A61G 7/0513 4/611
2014/0196799 A1 * 7/2014 Hsu ..... E02D 31/002 137/312
2014/0197168 A1 * 7/2014 Miller ..... B65D 19/18 220/4.33
2014/0352053 A1 * 12/2014 Conohan ..... A01K 13/001 4/559
2015/0320928 A1 * 11/2015 Allen ..... A61B 90/05 604/356
2015/0328393 A1 * 11/2015 Stephens ..... A61G 13/102 4/621
2016/0213562 A1 * 7/2016 Gathers ..... A61H 35/006
2018/0092329 A1 * 4/2018 Zemet ..... A01K 1/0052
2019/0174715 A1 * 6/2019 Miller ..... A01K 13/001

* cited by examiner

LIMB IRRIGATION PAN DEVICE

CROSS-REFERENCE TO RELATED APPLICATION

This application is a Continuation-In-Part of and claims priority from non-provisional U.S. patent application Ser. No. 14/279,414 filed on Mar. 16, 2014 and incorporates U.S. patent application Ser. No. 14/279,414 in its entirety.

TECHNICAL FIELD OF THE DISCLOSURE

The disclosure relates to pan devices and more particularly pertains to an improved limb irrigation pan device for collecting and removing irrigation fluid and debris from a surgical field when a limb is undergoing debridement and irrigation.

BACKGROUND OF THE INVENTION

Surgical accessories adopted to allow medical personnel to perform medical treatment on a patient or a portion of a patient while collecting waste fluid or the like generated from such treatment are known. The most common type being a simple basin or towel. Other more complicated and expensive accessories are also known.

For example, there have been known a bandaging table with a single liquid permeable surface containing several cut-outs which receive medical instruments or other items required during the bandaging procedure. This can include a surgical drainage attachment for use with a standard operating table. The attachment can comprise a basin having a screen on the top thereof for support of a hand or foot of the patient.

The surgery table for use on a hand can include a downwardly sloped upper operating surface with a plurality of drain holes positioned above a drain pan, which includes a hose for disposing of wastes.

The disadvantage of certain prior art devices is that they are not readily portable and/or disposable and can cumbersome and expensive.

SUMMARY OF THE DISCLOSURE

According to an embodiment of the present invention, there is disclosed a kit of parts for assembling a limb irrigation pan device. The kit includes a base having first and second opposing sides formed with alternating indentations and protrusions extending along the first and second opposing sides. A first side wall has alternating spaced indentations and protrusions formed along a bottom section of the first side wall to enable the first side wall to be mounted to the base by inserting the alternating spaced indentations and protrusions formed along the bottom section of first side wall into corresponding alternating indentations and protrusions along the first side of the base. A second side wall has alternating spaced indentations and protrusions formed along a bottom section of the second side wall to enable the second side wall to be mounted to the base by inserting the alternating spaced indentations and protrusions formed along the bottom section of the second side wall into corresponding alternating indentations and protrusions along the second side of the base. First and second end panels mount onto opposite ends of the base so as to extend upward and substantially perpendicular to the base in parallel relation to each other to form a frame with the first and second side walls. A sling has coupling components along two opposite sides. The coupling components are adapted to attach the sling to the first and second side walls whereby the sling is coupled to the frame.

According to another embodiment of the present invention, a method of assembling a limb irrigation pan device the following steps. A base having first and second opposing sides formed with alternating indentations and protrusions extending along the first and second opposing sides is provided. A first side wall is mounted to the base by inserting the alternating spaced indentations and protrusions formed along a bottom section of first side wall into corresponding alternating indentations and protrusions along the first side of the base. A second side wall is mounted to the base by inserting the alternating spaced indentations and protrusions formed along a bottom section of the second side wall into corresponding alternating indentations and protrusions along the second side of the base. First and second end panels are mounted onto first and second opposite ends of the base to extend upward and substantially perpendicular to the base and in parallel relation to each other to form a frame with the first and second side walls. A sling is coupled to the first and second side walls whereby the sling is coupled to the frame.

According to still another embodiment of the present invention, a limb irrigation pan device comprises a base having first and second opposing sides formed with alternating indentations and protrusions extending along first and second opposing sides. A first side wall having alternating spaced indentations and protrusions formed along a bottom section of the first side wall enables the first side wall to be mounted to the base by inserting the alternating spaced indentations and protrusions formed along the bottom section of first side wall into corresponding alternating indentations and protrusions extending along the first side of the base. A second side wall having alternating spaced indentations and protrusions formed along a bottom section of the second side wall enables the second side wall to be mounted to the base by inserting the alternating spaced indentations and protrusions formed along the bottom section of the second side wall into corresponding alternating indentations and protrusions extending along the second side of the base. First and second end panels are mounted onto opposite ends of the base so as to extend upward and substantially perpendicular to the base in parallel relation to each other to form a frame with the first and second side walls. A sling having coupling components along two opposite sides. The coupling components are adapted to attach the sling to the first and second side walls whereby the sling is coupled to the frame.

There has thus been outlined, rather broadly, the more important features of the disclosure in order that the detailed description thereof that follows may be better understood, and in order that the present contribution to the art may be better appreciated.

There are additional features of the disclosure that will be described hereinafter and which will form the subject matter of the claims appended hereto.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

DESCRIPTION OF THE PREFERRED EMBODIMENT

Figure 1:
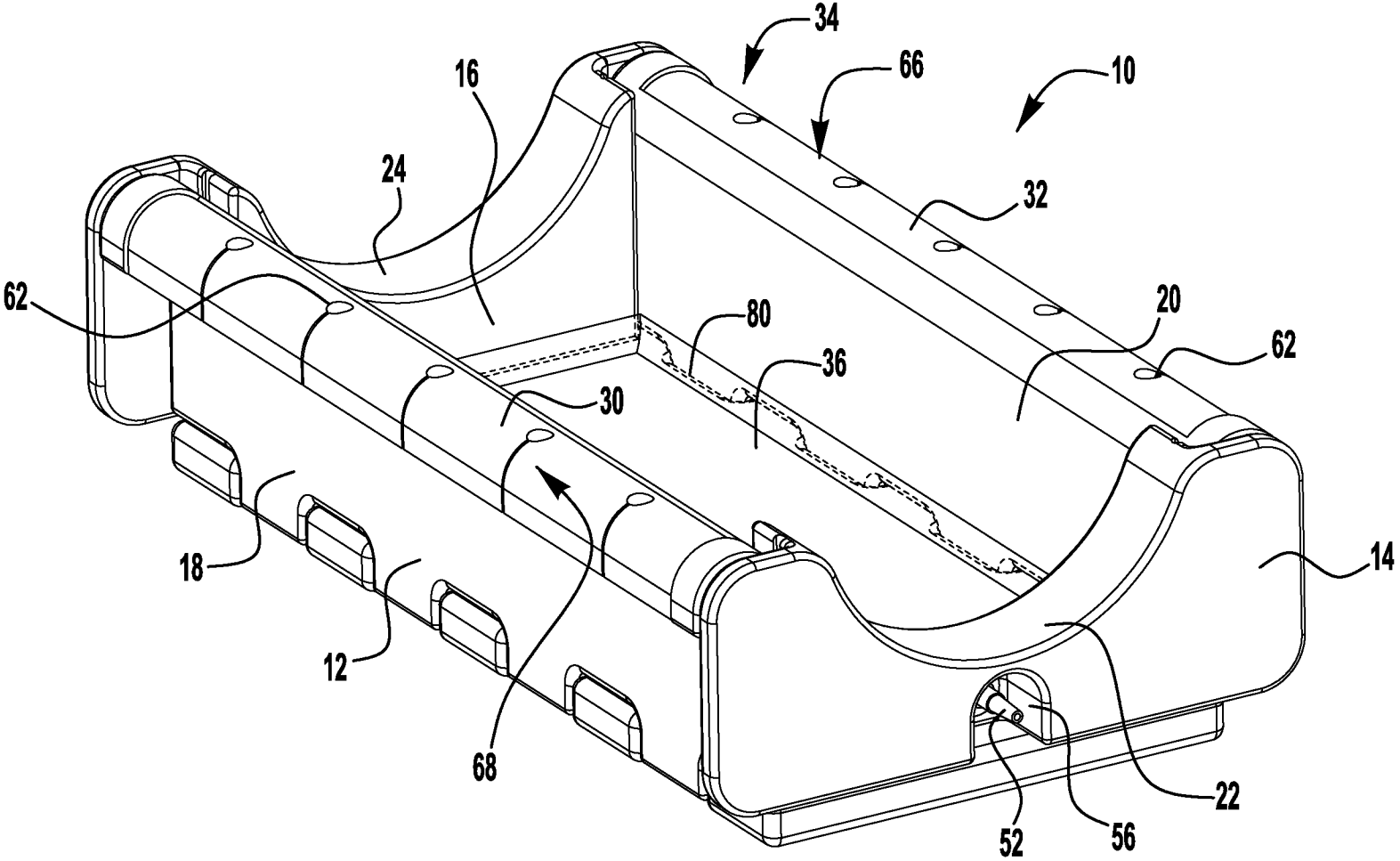
FIG. 1 is a top, front side perspective view of a limb irrigation pan device, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

With reference now to the drawings, and in particular to FIGS. 1 through 5 thereof, a new limb irrigation pan device embodying the principles and concepts of an embodiment of the disclosure and generally designated by the reference numeral 10 will be described.

As best illustrated in FIGS. 1 through 5, the limb irrigation pan device 10 generally comprises a frame 12 having a pair of opposed end panels 14 and 16, a pair of longitudinal side walls 18 and 20 extending between the opposed end panels 14 and 16. Each of the opposed end panels 14 and 16 has a respective upper surface 22 and 24, respectively. The upper surface 22 and 24 of each opposed end panel 14 and 16, respectively, is concavely arcuate to facilitate positioning of a limb 26 to extend over the frame 12 and between the longitudinal side walls 18 and 20. The frame 12 may have a length sufficient to accommodate a limb 26, such as an arm 26 or a leg (not shown). This can be achieved with a length between 45 and 65 centimeters. An upper edge 28 of the frame 12 extending fully around the frame and including the upper surfaces 22 and 24 of each opposed end panel 14 and 16, respectively, and the upper edges 30 and 32 of the longitudinal side walls 18 and 20 define an open top 34 of the frame 12. Space between the longitudinal side walls 18 and 20 may be between 15 and 25 centimeters. A height of the frame 12 may be between 10 and 16 centimeters.

A base 36 is coupled to and extends between the opposed end opposed end panels 14 and 16. The base 36 is further coupled to and extends between the longitudinal side walls 18 and 20. The base 36 defines a well 38 between the opposed end panels 14 and 16 and longitudinal side walls 18 and 20 such that the well 38 is configured for collecting a fluid 40 passed into the frame 12 through the open top 34. A sling 42 is coupled to the frame 12. The sling 42 is porous and may be formed by a flexible sheet of material such as sterile cotton, nylon, or other conventional material suitable for use in a medical setting. The sling 42 is configured for passing the fluid 40 through the sling to be collected in the well 38. Each of a pair of side edges 44 and 46 of the sling 42 is coupled to an associated one of the longitudinal side walls 18 and 20 of the frame 12. The sling 42 and upper surfaces 22 and 24 of the opposed end walls 14 and 16 are sized to substantially align end edges 44 and 46 of the sling 42 with the upper surfaces 22 and 24 of end panels 14 and 16. Thus, the sling 42 is configured for supporting the limb 26 over the well 38. The sling 42 may be either constructed of a material which can be cleaned and re-sterilized for repeated use or made to be disposable after a single use.

A drain 48 is coupled to the frame 12. The drain 48 is in fluid communication with the well 38 wherein the drain 48 is configured for draining the fluid 40 from the well 38. The drain 48 may be positioned at an end of the well 38. A nozzle 52 may be detachably coupled to the drain 48. A coupler 54, such as a chain, line, or the like, has a first end coupled to the nozzle 52 and a second end coupled to the frame 12 to prevent loss of the nozzle 52. A drain slot 56 can be provided in the end panel 14 to allow the nozzle 52 to extend through the end panel 14 when the nozzle 52 is coupled to the drain 48. The frame 12, the drain 48, and the nozzle 52 may each be constructed of a durable material suitable for being sterilized between uses.

Each of a pair of end pads 58 and 60 are coupled to an associated one of the opposed end walls 14 and 16, respectively, of the frame 12 covering the upper surfaces 22 and 24 of the associated opposed end walls 14 and 16. Each pad 58 and 60 is provided to comfortably support the limb 26. Each pad 58 and 60 may further comprise a non-absorbent, outer surface 58*a* and 60*a*, respectively, to facilitate creating a seal between the pads 58 and 60 and the limb 26 to inhibit the fluid 40 from spilling over the pads 58 and 60. Each of the pads 58 and 60 has an arcuate shape with a lower surface 58*b* and 60*b* formed with a rectangular shaped groove 58*c* and 60*c* that can be seated with the bottom wall 58*d* and 60*d* of the pads 58 and 60 disposed against the upper surfaces 22 and 24 of the associated opposed end walls 14 and 16. The sidewalls of the rectangular shaped groove 58*c* and 60*c* are pressed against the inner and outer facing surfaces of the end panels 14 and 16 when the pads 58 and 60 are mounted onto the opposed end walls 14 and 16 so that the pads 58 and 60 remain in place.

Figure 3:
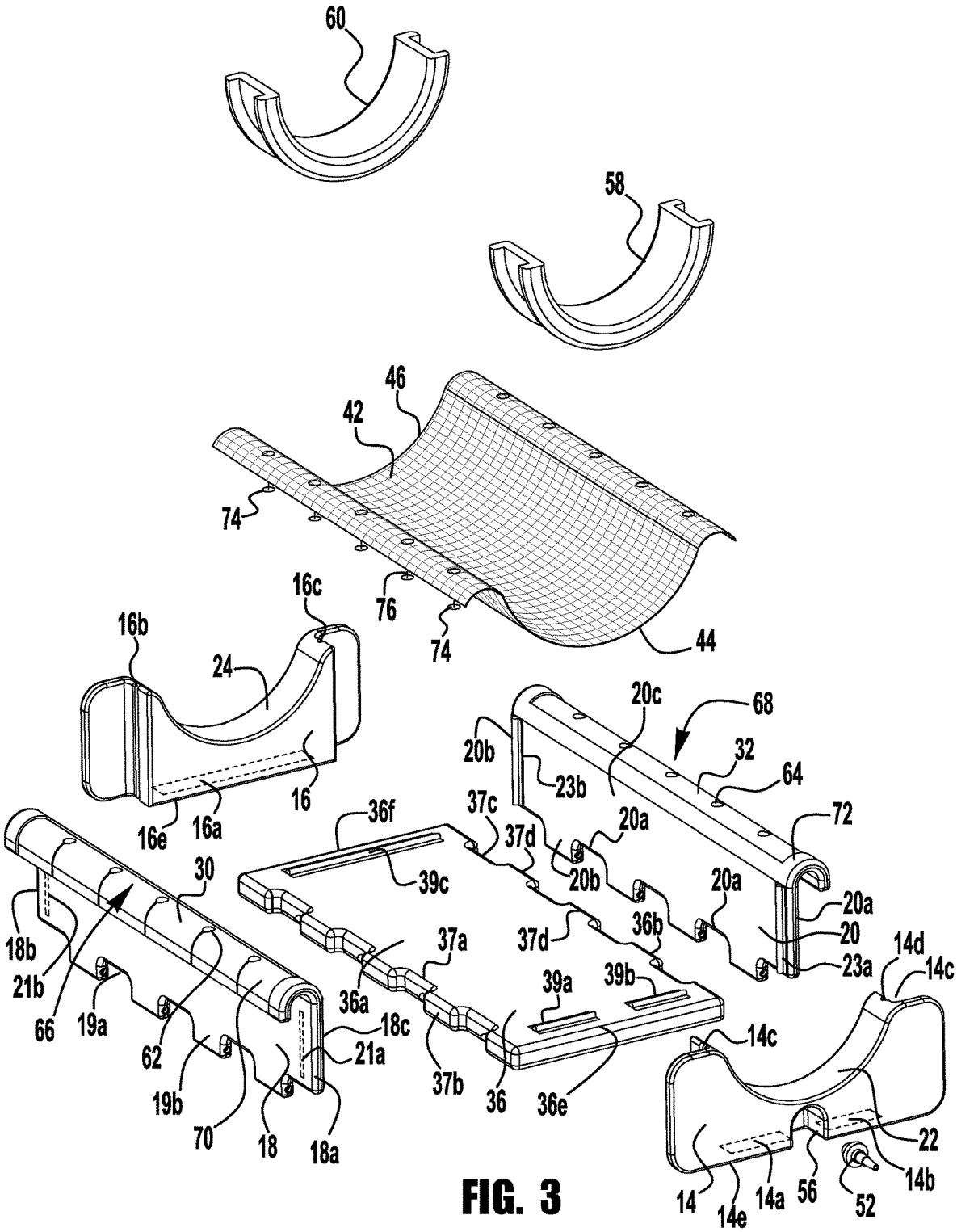
FIG. 3 is top perspective view of the housing of an unassembled limb irrigation pan device, in accordance with the present invention.

Each of a plurality of holes 62 and 64 extends through the frame 12. The holes 62 and 64 are arranged into two rows 66 and 68 which extend along an associated one of the upper edges 30 and 32 of the longitudinal side walls 18 and 20, respectively. Each row 66 and 68 may extend through a lip 70 and 72, as best seen in FIG. 3, extending arcuately outwardly and downwardly away from the upper edges 30 and 32 of the longitudinal side walls 18 and 20. Coupling components, such as a plurality of disks 74, as best seen in FIG. 3, are coupled along the pair of side edges 44 and 46 of the sling 42, and can be coupled to an associated one of the longitudinal side walls 18 and 20 of the frame 12. Each disk 74 is received through an associated one of the holes 62 wherein the sling 42 is coupled to the frame 12. Each of a plurality of tethers 76 is coupled to and extends between the sling 42 and an associated one of the disks 74 facilitating insertion of each disk 74 into the associated holes 62 and 64.

Figure 4:
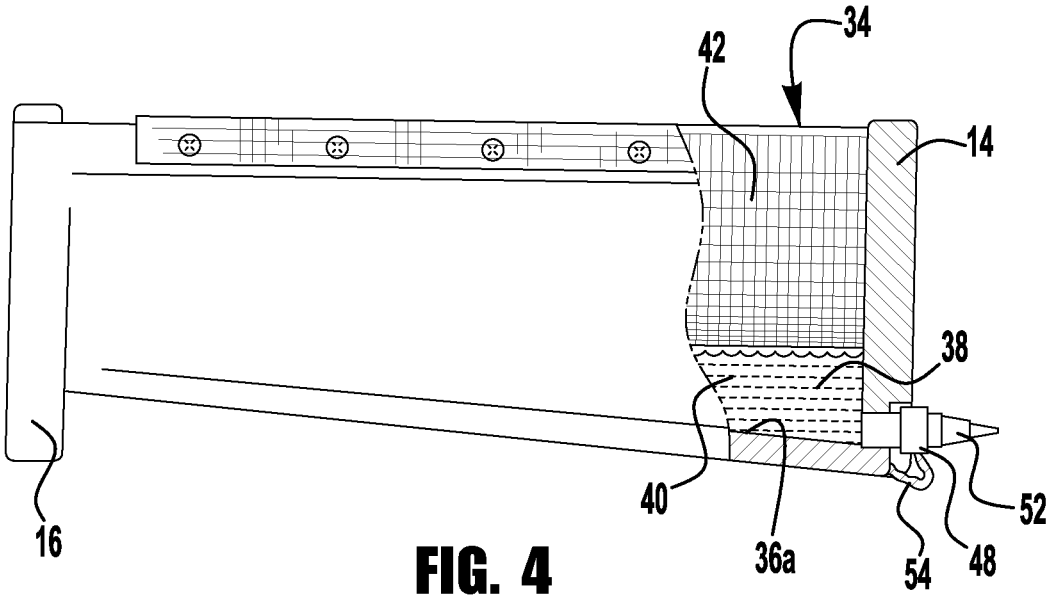
FIG. 4 is a partial cut-away side view of an embodiment of the disclosure.
Figure 5:
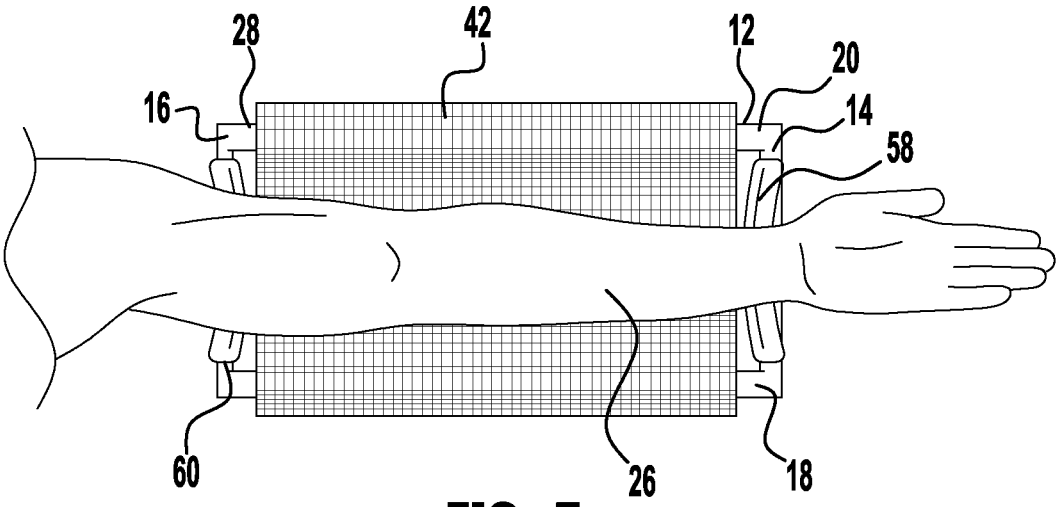
FIG. 5 is a top view of an embodiment of the disclosure in use.

A bottom surface 36*a* of the base 36 forms the well 38 and can be, if desired, sloped towards the drain 48, as shown in FIG. 4. A drain slot 56 extends through one of the opposed end walls 14 of the frame 12. The drain 48 is positioned adjacent to the drain slot 56 and the nozzle 52 extends through the drain slot 56 when the nozzle 52 is coupled to the drain 42. An outer surface of the nozzle 52 may be elongated and grooved wherein the nozzle 52 is graduated and configured for coupling to a tube (not shown) such that the tube is in fluid communication with the well 38 whereby the fluid 40 may be drained from the well 38 through the tube to control ultimate collection and disposal of the fluid 40 and debris collected within the well 38.

Figure 2:
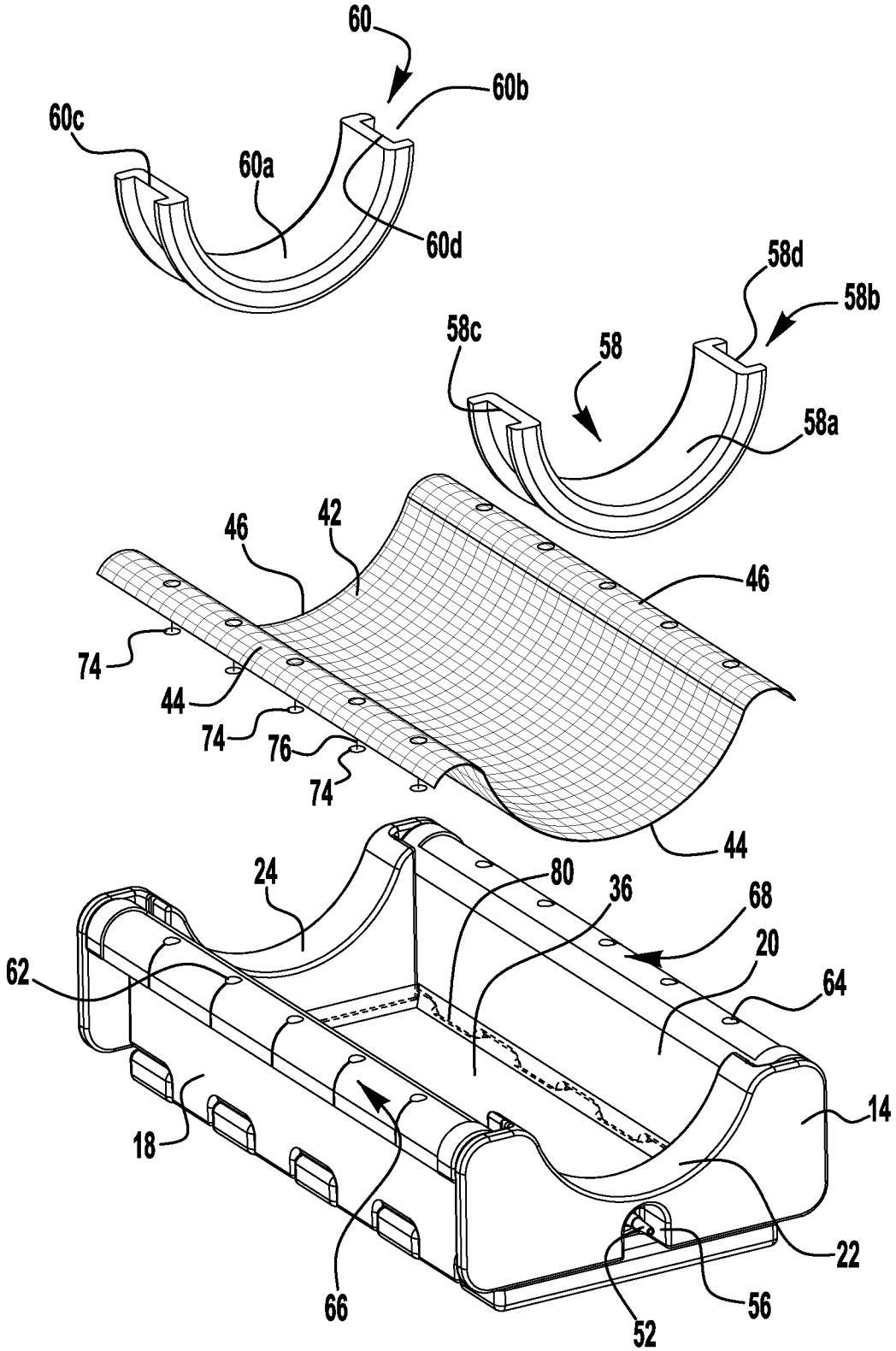
FIG. 2 is a partially exploded, top front side perspective view of a limb irrigation pan device, in accordance with the present invention.

The limb irrigation pan device 10 is preferably provided as a kit, which is useful in military settings, and which is shown disassembled in FIG. 3. An aspect of the present invention is to provide a limb irrigation pan device 10 which can be easily transported by a medical person and then quickly assembled as shown in FIG. 2.

First, the base 36 is placed on a surface. The sides 36*a* and 36*b* of the base 36 are formed with alternating indentations 37*a* and protrusions 37*b* alongside 36*a* and alternating indentations 37*c* and protrusions 37*d* alongside 36*b*, respectively. The protrusions 37*b* and 37*d* can have a depression on either side to receive a nipple shaped projection disposed on either side of protrusions 19*b* of sidewall 18 and either side of protrusions 37*d* of the sidewall 20 so that the sidewalls 18 and 20 can be removably interlocked with the base 36, as discussed hereinafter.

On opposite ends 36*e* and 36*f* of the base 36, upstanding elongated ribs 39*a*, 39*b* and 39*c* are disposed in parallel relationship to each other. Note that ribs 37*a* and 37*b* are separated to accommodate the arcuate section 56. Next, the opposed end panels 14 and 16 are mounted onto the base 36 so that the upstanding elongated ribs 39*a* and 39*b* are received in spaced slots 14*a* and 14*b* formed in the bottom surface 14*e* of end panel 14 and upstanding elongated rib 39*c* is received in slot 16*a* formed in the bottom surface 16*e* of the end panel 16. Thus the opposed end panels 14 and 16 can be firmly, but removably mounted so as to extend upward and substantially perpendicular to the base 36 in parallel relation to each other.

The side wall 18 can then mounted to the base 36 by interconnecting alternating spaced indentations 19*a* and protrusions 19*b* formed along the bottom section of side wall 18 into the corresponding alternating indentations 37*a* and protrusions 37*b* alongside 36*a* of the base 36. A pair of ribs 21*a* and 21*b* are disposed adjacent the ends 18*a* and 18*b* of side wall 18 and extend outward from the inner facing wall 18*c*. The ribs 21*a* and 21*b* are received within vertically disposed slots 14*c* and 16*b* formed on the side facing surfaces of the portion of the end panels 14 and 16, respectively, adjacent the upper surfaces 22 and 24. In this configuration the side wall 18 is firmly secured to the base 36 and between the end panels 14 and 16.

The side wall 20 can then be mounted to the base 36 by interconnecting alternating spaced indentations 20*a* and protrusions 20*b* formed along the bottom section of side wall 20 into the corresponding alternating indentations 37*c* and protrusions 37*d* provided alongside 36*b* of the base 36. A pair of ribs 23*a* and 23*b* are disposed adjacent the ends 20*a* and 20*b* and extend along the inner facing wall 20*c*. The ribs 23*a* and 23*b* are received within slots 14*d* and 16*c* formed on the side facing surfaces of the portion of the end panels 14 and 16, respectively, extending downward from the upper surfaces 22 and 24. In this configuration the side wall 20 is firmly secured to the base 36 and the end panels 14 and 16.

Next, a rectangular gasket 80 can be inserted into the assembled frame 12 to rest on the base 36 and against the sidewalls 18 and 20 and the end panels 14 and 16 so that any fluid 40 which accumulates in the well 38 does not leak from the edges of the assembled frame but instead drained from the well through nozzle 52 as needed.

At this stage of the construction, end pads 58 and 60 are mounted to an associated one of the opposed end walls 14 and 16, respectively, of the frame 12 covering the upper surfaces 22 and 24 of the associated opposed end walls 14 and 16. The pads are provided to comfortably support the limb 26. Depending on the limb, i.e. and arm or a leg, the end pads 58 and 60 can be of a different radius. The rectangular shaped groove 58*c* and 60*c* formed with an arcuate shape can be seated with the bottom wall 58*d* and 60*d* of the pads 58 and 60 disposed against the upper surfaces 22 and 24 of the associated opposed end walls 14 and 16. The sidewalls of the rectangular shaped groove 58*c* and 60*c* are pressed against the inner and outer facing surfaces of the end panels 14 and 16 when the pads 58 and 60 are mounted onto the opposed end walls 14 and 16 so that the pads 58 and 60 remain in place.

Next, a rectangular gasket 80 can be inserted into the assembled frame 12 to rest on the base 36 and against the sidewalls 18 and 20 and the end panels 14 and 16 so that any fluid 40 which accumulates in the well 38 does not leak from the edges of the assembled frame but instead drained from the well through nozzle 52 as needed.

The sling 42 can now be coupled to the assembled frame 12 by coupling the plurality of disks 74 to an associated one of the longitudinal side walls 18 and 20 of the frame 12. Each disk 74 is received through an associated one of the holes 62 wherein the sling 42 is coupled to the frame 12. Each of a plurality of tethers 76 is coupled to and extends between the sling 42 and an associated one of the disks 74 facilitating insertion of each disk 74 into the associated hole 62.

The limb irrigation pan device 10 is used when irrigating a wound on the limb 26. The sling 42 is coupled to the frame 12 and the limb 26 is supported on the frame 12 and sling 42 to position the wound over the well 38. The fluid 40 may then be washed over the limb 26 and into the wound to cleanse the wound and remove debris. The fluid 40 drains through the sling 42 and is collected in the well 38 and subsequently drained from the well through the drain 48. Debris passes through the sling 42. Thus, the limb irrigation pan device 10 facilitates collection of the fluid 40 and debris.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A kit of parts for assembling a limb irrigation pan device comprising:

a base having first and second opposing sides formed with alternating indentations and protrusions extending along the first and second opposing sides, said base having first and second opposite ends each having at least one upstanding elongated rib:

a first side wall having alternating spaced indentations and protrusions formed along a bottom section of the first side wall to enable the first side wall to be mounted to the base by inserting the alternating spaced indentations and protrusions formed along the bottom section of first side wall into corresponding alternating indentations and protrusions along the first side of the base;

a second side wall having alternating spaced indentations and protrusions formed along a bottom section of the second side wall to enable the second side wall to be mounted to the base by inserting the alternating spaced indentations and protrusions formed along the bottom section of the second side wall into corresponding alternating indentations and protrusions along the second side of the base;

first and second end panels for mounting onto opposite ends of the base so as to form a frame with the first and second side walls, said first and second end panels each having at least one slot formed in a bottom surface to receive the at least one upstanding rib at the first and second opposite ends of the base; and a sling having coupling components along two opposite sides, the coupling components being adapted to attach the sling to the first and second side walls whereby the sling is coupled to the frame.

2. The kit of parts for assembling a limb irrigation pan device of claim 1 further including a rectangular gasket adapted to be inserted into the frame after it has been assembled.

3. The kit of parts for assembling a limb irrigation pan device of claim 1 wherein the first and second end panels are firmly mounted so as to extend upward and substantially perpendicular to the base in parallel relation to each other.

4. The kit of parts for assembling a limb irrigation pan device of claim 3 further including:

the first and second side walls each having a pair of ribs disposed adjacent the ends of the first and second side walls wherein the pair of ribs extend outward from an inner facing wall of the first and second side walls; and vertically disposed slots formed on side facing surfaces of the end panels into which the pair of ribs extending outward from an inner facing wall of the first and second side walls are received whereby the first and second side walls are firmly secured to the base between the end panels.

5. The kit of parts for assembling a limb irrigation pan device of claim 1 further including first and second pads each having a non-absorbent, arcuate outer surface to comfortably support a limb, the first and second pads being mounted to corresponding upper surfaces of the first and second end panels.

6. The kit of parts for assembling a limb irrigation pan device of claim 1 further including providing each of the first and second side walls with a row of holes extending along an upper edge of the side wall and through a lip extending arcuately outwardly and downwardly away from the upper edges of the side wall.

7. The kit of parts for assembling a limb irrigation pan device of claim 1 wherein the sling is porous and formed of a flexible sheet of material for passing fluid through the sling to be collected in a well formed by the base having the first and second opposing sides and the first and second end panels mounted thereto.

8. A method of assembling a limb irrigation pan device, comprising:

providing a base having first and second opposing sides formed with alternating indentations and protrusions extending along the first and second opposing sides, said base having first and second opposite ends each having at least one upstanding elongated rib;

mounting a first side wall to the base by inserting the alternating spaced indentations and protrusions formed along a bottom section of first side wall into corresponding alternating indentations and protrusions along the first side of the base;

mounting a second side wall to the base by inserting the alternating spaced indentations and protrusions formed along a bottom section of the second side wall into corresponding alternating indentations and protrusions along the second side of the base;

mounting first and second end panels onto first and second opposite ends of the base to form a frame with the first and second side walls, said first and second end panels each having at least one slot formed in a bottom surface to receive the at least one upstanding rib at the first and second opposite ends of the base; and coupling a sling to the first and second side walls whereby the sling is coupled to the frame.

9. The method of claim 8 further including inserting a rectangular gasket into the frame at the intersection of the base and the first and second side walls and the base and the first and second end panels.

10. The method of claim 8 further including mounting the first and second end panels on opposite ends of the base firmly to extend upward and substantially perpendicular to the base in parallel relation to each other.

11. The method of claim 10 further including:

inserting a first pair of ribs disposed adjacent ends of the first side wall into first and second vertically disposed slots formed on first side facing surfaces of the first and second end panels;

inserting a second pair of ribs disposed adjacent ends of the second side wall into first and second vertically disposed slots formed on second side facing surfaces of the first and second end panels;

whereby the first and second side walls are firmly secured to the base between the first and second end panels.

12. The method of claim 8 further including mounting first and second pads to corresponding upper surfaces of the first and second end panels, said first and second pads each having a non-absorbent, arcuate outer surface to comfortably support a limb.

13. The method of claim 8 further including providing each of the first and second side walls with a row of holes extending along an upper edge of the side wall and through a lip extending arcuately outwardly and downwardly away from the upper edge of the side wall.

14. The method of claim 8 further including providing the sling of a flexible sheet of porous material for passing fluid through the sling to be collected in a well formed by the base having the first and second opposing sides and the first and second end panels mounted thereto.

15. A limb irrigation pan device, comprising:

a base having first and second opposing sides formed with alternating indentations and protrusions extending along first and second opposing sides, said base having first and second opposite ends each having at least one upstanding elongated rib;

a first side wall having alternating spaced indentations and protrusions formed along a bottom section of the first side wall to enable the first side wall to be mounted to the base by inserting the alternating spaced indentations and protrusions formed along the bottom section of first side wall into corresponding alternating indentations and protrusions extending along the first side of the base;

a second side wall having alternating spaced indentations and protrusions formed along a bottom section of the second side wall to enable the second side wall to be mounted to the base by inserting the alternating spaced indentations and protrusions formed along the bottom section of the second side wall into corresponding alternating indentations and protrusions extending along the second side of the base;

first and second end panels mounted onto opposite ends of the base so as to form a frame with the first and second side walls, said first and second end panels each having at least one slot formed in a bottom surface to receive the at least one upstanding rib at the first and second opposite ends of the base; and a sling having coupling components along two opposite sides, the coupling components adapted to attach the sling to the first and second side walls whereby the sling is coupled to the frame.

16. The limb irrigation pan device of claim 15 further including a rectangular gasket adapted to be inserted into the frame after it has been assembled.

17. The limb irrigation pan device of claim 15 wherein the first and second end panels are firmly mounted so as to extend upward and substantially perpendicular to the base in parallel relation to each other.

18. The limb irrigation pan device of claim 15 further including:

the first and second side walls each having a pair of ribs disposed adjacent the ends of the first and second side walls wherein the pair of ribs extend outward from an inner facing wall of the first and second side walls; and vertically disposed slots formed on side facing surfaces of the end panels into which the pair of ribs extending outward from an inner facing wall of the first and second side walls are received whereby the first and second side walls are firmly secured to the base between the end panels.

19. The limb irrigation pan device of claim 15 wherein each of the first and second side walls has a row of holes extending along an upper edge of the first and second side walls and through a lip extending arcuately outwardly and downwardly away from the upper edges of the side wall.

20. The limb irrigation pan device of claim 15 wherein the sling is porous and formed of a flexible sheet of material for passing fluid through the sling to be collected in a well formed by the base having the first and second opposing sides and the first and second end panels mounted thereto.

* * * * *